United States Patent [19]

Campbell

[11] 4,089,073

[45] May 16, 1978

[54] COMBINATION FIXTURE WITH SWING-OUT LAVATORY

[75] Inventor: J. Les Campbell, Burlingame, Calif.

[73] Assignee: Aluminum Plumbing Fixture Corp., Burlingame, Calif.

[21] Appl. No.: 727,720

[22] Filed: Sep. 29, 1976

[51] Int. Cl.[2] ..... E03D 11/00; E03D 11/13

[52] U.S. Cl. ..... 4/3; 4/312; 4/166; 4/168; 4/169; 4/167

[58] Field of Search ..... 4/DIG. 2, 1, 10, 167, 4/168, 169, 2, 3, 4, 166

[56] References Cited

U.S. PATENT DOCUMENTS

| | | | |
|---|---|---|---|
| 526,240 | 9/1894 | Leyare | 4/168 |
| 2,184,722 | 12/1939 | McLoughlin | 4/169 |
| 2,375,090 | 5/1945 | Eckhardt et al. | 4/3 |
| 2,907,048 | 10/1959 | Gould | 4/2 |
| 3,720,961 | 3/1973 | Garvey | 4/1 |
| 3,887,947 | 6/1975 | Tosca | 4/2 |

*Primary Examiner*—Henry R. Artis
*Attorney, Agent, or Firm*—Robert G. Slick

[57] ABSTRACT

A combination wash basin and toilet fixture is provided wherein the wash basin is mounted over the toilet and swings out of the way to permit the use of the toilet. When the wash basin is swung over the toilet, the fixture appears to be an ordinary wash basin.

2 Claims, 2 Drawing Figures

COMBINATION FIXTURE WITH SWING-OUT LAVATORY

SUMMARY OF THE INVENTION

The present invention relates to a combination wash basin and toilet wherein the wash basin is mounted over the toilet and swings out of the way when one wishes to use the toilet. The wash basin is ordinarily provided with a long skirt which completely conceals the toilet when the wash basin is in position for use so that an attractive fixture is provided. Toilets are unattractive and ordinarily are not installed in bedrooms or dressing rooms for this reason. Thus, the device of the present invention provides an attractive fixture which can be installed in locations where a toilet would be unacceptable from an aesthetic standpoint.

Combination fixtures have been proposed in the past but these have been of more complicated mechanical construction than the present invention since they have ordinarily involved a toilet which swings out or raises up. Thus, it is necessary to provide rotating plumbing connections for both the flushing water and the waste. In contrast, the present invention employs only one rotating connection and this is for the wash basin waste. This is not under pressure so that a relatively simple and inexpensive rotating connection can be employed.

Thus, the present invention relates to a combination toilet and lavatory which is attractive in appearance and relatively inexpensive to manufacture.

Various other features and advantages of the present invention will be brought out in the balance of the specification.

DESCRIPTION OF THE PREFERRED EMBODIMENTS

Figure 1:
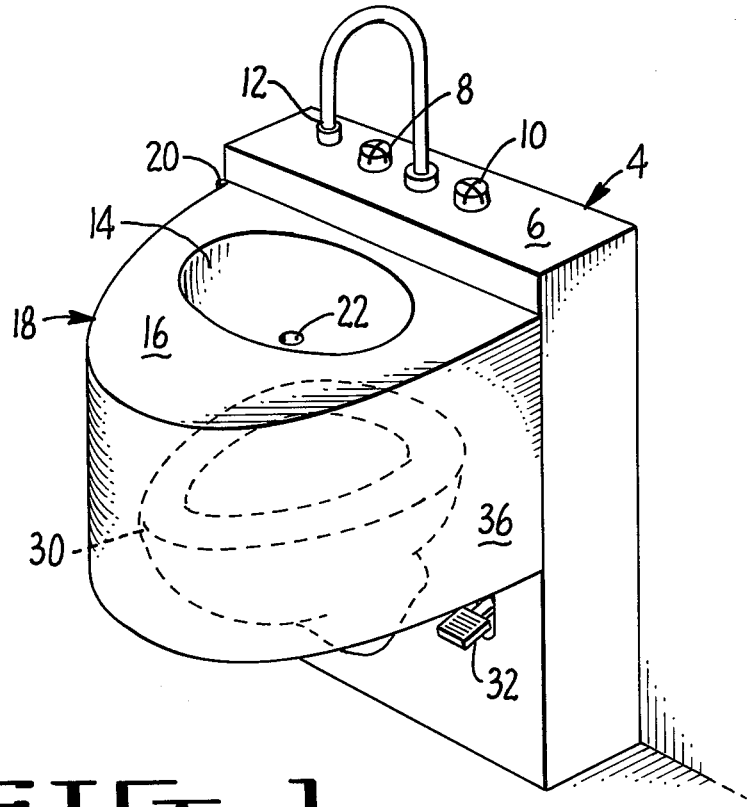
FIG. 1 is a perspective view of a combination toilet fixture embodying the present invention showing the wash basin in place over the toilet bowl.
Figure 2:
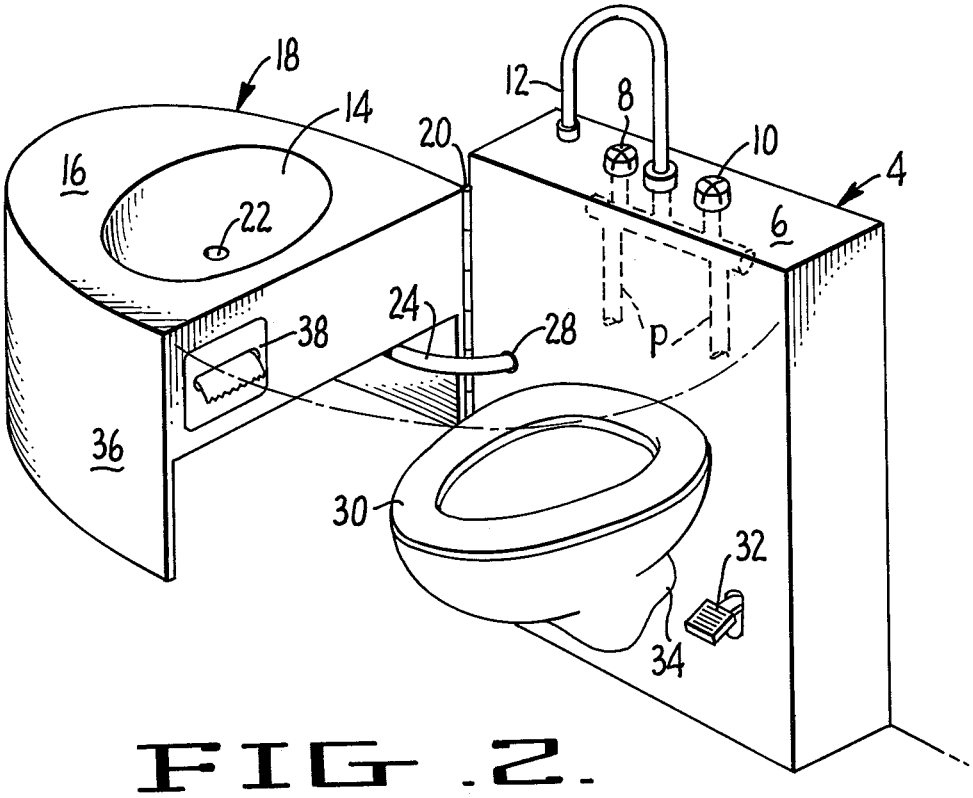
FIG. 2 is a view similar to FIG. 1 showing the wash basin swung out of the way so that the toilet can be used.

Referring now to the drawings by reference characters, the fixture of the present invention is mounted on a cabinet 4 which can be placed against a wall. The cabinet has a top surface 6 and has the usual handles 8 and 10 controlling hot and cold water respectively, from supply pipes.

Water goes to outlet 12 which discharges into the wash bowl. The wash bowl 14 is formed in the top surface 16 of a swinging member or wash basin 18. The member or basin 18 is mounted for swinging motion on a hinge 20. The wash basin has the usual outlet 22 and this leads to a flexible discharge pipe 24 for the ultimate discharge of the waste wash basin water through outlet 28.

Also mounted on the cabinet 4 is the toilet proper 30. A foot actuated flushing lever 32 is provided on the cabinet although, of course, a hand-operated lever might be located higher on the cabinet. The toilet bowl 30 discharges through line 34 into the cabinet where it is provided with suitable piping.

Preferably the swinging portion of the fixture 18 is provided with a long skirt 36 which extends downwardly from the top of the wash basin so that when the wash basin is in place over the toilet as is shown in FIG. 1, the toilet is completely concealed. The usual toilet paper holder 38 can also be mounted on the swinging portion of the fixture.

It is believed apparent from the foregoing that I have provided a combination wash basin and toilet fixture which is simple and inexpensive of structure and which is attractive in appearance so that it can be installed in a bedroom or the like.

I claim:

1. A combination fixture comprising in combination:

a. a cabinet having a top surface, a front surface, and a generally planar rear surface adapted to be mounted flush against a substantially flat wall surface;

b. a wash basin hingedly connected at one edge thereof to one edge of said cabinet, whereby it can be swung in a horizontal plane from a first position against the front surface of the cabinet to a second position at substantially right angles to said cabinet;

c. said wash basin having a top surface with a wash bowl therein;

d. a toilet mounted on the front surface of said cabinet and extending outwardly therefrom, said wash bowl overlying said toilet in the first position and extending clear of the toilet when in the second position;

e. a skirt on said wash basin extending downwardly from the front and sides of said wash basin, said skirt extending downwardly from the top of said wash basin to below the top of said toilet whereby said skirt conceals the toilet when the wash basin is in the first position;

f. a water outlet faucet and hot and cold water control knobs supported on the cabinet, said faucet positioned to discharge water into the wash bowl when the wash basin is in its first position;

g. water supply pipes extending in said cabinet to said faucet and to said toilet; and h. a flexible water discharge conduit extending from the wash basin into the cabinet and being separate from the hinged connection between the cabinet and wash basin.

2. A combination fixture as in claim 1 wherein a toilet paper holder is carried by said wash basin in a position to be hidden from view when the wash basin is in its first position, and a flush actuating lever for the toilet is mounted on the cabinet for easy access.

* * * * *